United States Patent [19]

Quarrell et al.

[11] Patent Number: 4,552,264

[45] Date of Patent: Nov. 12, 1985

[54] JEWELRY CONTAINER

[75] Inventors: Richard Quarrell; Paul A. Ranson, both of New York, N.Y.

[73] Assignee: General Mills Products Corp., Minneapolis, Minn.

[21] Appl. No.: 593,999

[22] Filed: Mar. 27, 1984

[51] Int. Cl.[4] ..... B65D 5/50; B65D 73/00

[52] U.S. Cl. ..... 206/45.14; 206/45.19; 206/45.34; 206/458; 206/566

[58] Field of Search ..... 206/45.14, 45.19, 45.34, 206/457, 458, 566

[56] References Cited

U.S. PATENT DOCUMENTS

| | | | |
|---|---|---|---|
| D. 147,256 | 8/1947 | Waldron | 206/566 |
| 633,714 | 9/1899 | Caille | 206/566 |
| 1,179,890 | 4/1916 | Boynton et al. | 206/45.34 |
| 2,144,336 | 1/1939 | Katz | 206/45.34 |
| 2,868,367 | 1/1959 | Shiffman | 206/566 |
| 3,045,812 | 7/1962 | Randolf | 206/45.19 |
| 3,351,186 | 11/1967 | Harris | 206/566 |
| 4,011,942 | 3/1977 | Crosslen | 206/45.34 |
| 4,261,461 | 4/1981 | Kizlauskas | 206/566 |
| 4,341,300 | 7/1982 | Roy | 206/45.14 |
| 4,371,077 | 2/1983 | Solitt et al. | 206/458 |

FOREIGN PATENT DOCUMENTS

| | | | |
|---|---|---|---|
| 2900450 | 7/1980 | Fed. Rep. of Germany | 206/566 |

OTHER PUBLICATIONS

United States Box Corporation, Gift and Jewel Box Catalog, pp. 42 and 43, 1/1982.

*Primary Examiner*—William T. Dixson, Jr.
*Assistant Examiner*—Brenda J. Ehrhardt
*Attorney, Agent, or Firm*—Gene O. Enockson; L. MeRoy Lillehaugen; Stuart R. Peterson

[57] ABSTRACT

The self-service jewelry container includes a relatively rigid cup-shaped base, a relatively resilient pedestal and a relatively rigid transparent cylindrical cover having a slant top. The base and cover can be taped together to render the container more pilfer-resistant. A predetermined angular relationship is established between the base and pedestal by means of an interfitting rib and groove configuration, and a predetermined angular relationship is established between the base and cover by means of a notch and tab. Lips on the base and cover telescopically interfit. In this way, when the several parts constituting the container are assembled, the slant top is properly oriented with the pedestal for the display of the jewelry mounted on the pedestal within the transparent cover. Two pedestal embodiments are disclosed, one for holding a flexible necklace and the other for holding a bangle.

16 Claims, 12 Drawing Figures

Fig.5
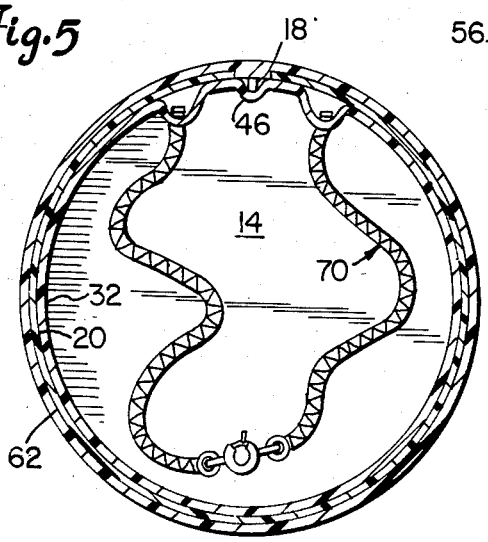
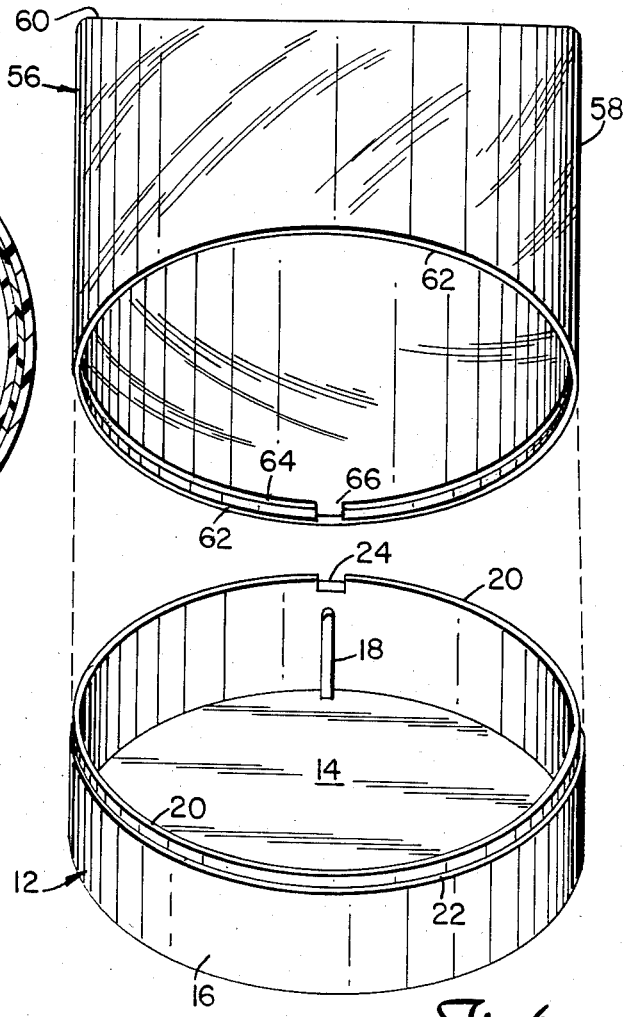
Fig.6
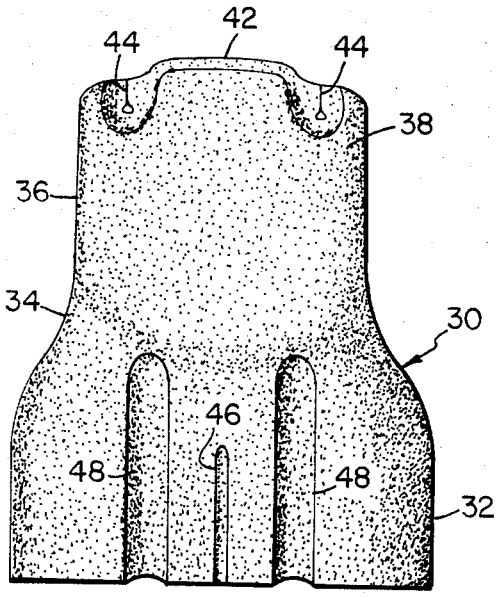
Fig.7
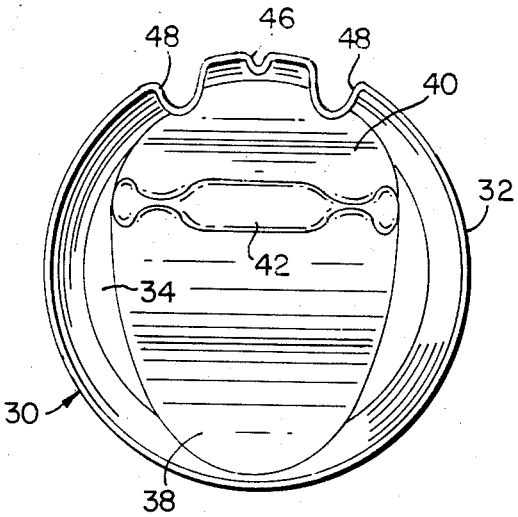
Fig.8

JEWELRY CONTAINER

BACKGROUND OF THE INVENTION

This invention relates generally to jewelry containers, and pertains more particularly to a self-service container for individually displaying jewelry articles, such as necklaces, bracelets, bangles, finger rings, pairs of earrings and the like.

SUMMARY OF THE INVENTION

A specific object of the invention is to provide a jewelry container having a base, removable cover and pedestal, the invention providing means for automatically orienting the cover relative to the base and relative to the pedestal.

Another object of the invention is to display various kinds of jewelry on an individual basis and in a three dimensional manner.

Another object is to provide a jewelry container that will be aesthetically pleasing, yet not divert attention from the particular jewelry item being displayed. In this regard, an aim of the invention is to provide a container suitable for effectively displaying jewelry in stores, especially where self-service merchandising is employed.

Still further, an object of the invention is to provide a jewelry container that is quite simple, yet pilfer-resistant. In this regard, it is planned that the customer purchase the jewelry item without opening the container, the cover being sealed to the base by means of a strip of tape which is difficult to surreptitiously take off, or, if preferred, almost impossible to remove if an appropriate tape material and adhesive are employed. Therefore, an aim of the invention is to thwart theft of jewelry in stores, the opening of a container by the prospective customer in order to remove the jewelry being readily apparent to a sales clerk or store detective.

Yet another object of the invention is to provide a jewelry container that will be inexpensive to manufacture, thereby encouraging its widespread use for both merchandizing and personal purposes.

Another object of the invention is to provide a versatile container that lends itself to employing a type of pedestal most suitable for the specific jewelry article to be displayed.

Briefly, the invention envisages a cup-shaped base having a circular bottom and an upstanding cylindrical wall. At the upper end of the cylindrical wall is a radially inset lip, the lip being interrupted at one angular location to form a notch. The insetting of the lip forms a circumjacent shoulder. In vertical alignment therewith and spaced beneath the notch is a longitudinal rib.

A resilient pedestal is formed with a lower portion having a diameter such that it can be readily inserted within the cylindrical wall, the pedestal being in the form of a thin shell. A vertical groove in the cylindrical portion of the pedestal enables the pedestal to be angularly oriented relative to the cup-shaped base, the rib on the cylindrical wall extending into the groove in establishing the desired angular relationship. An intermediate portion of the pedestal tapers inwardly and upwardly to form two sloping, generally flat surfaces. The flat surfaces converge at their upper end. In one embodiment of the pedestal for use in displaying a necklace, two vertical slits releasably hold segments of the necklace. The pedestal in this instance has two additional grooves, one to either side of the aligning groove, so that the pedestal can be readily inserted and so that portions of the necklace can pass downwardly into the cup-shaped base when the pedestal is inserted therein. In a second embodiment of the pedestal, where a bangle is to be displayed, one of the two sloping generally flat surfaces is formed with a semicircular shoulder on which the lower half of the bangle rests.

A transparent cover has a slant top and a radially outset lip that is of proper diameter so as to telescopically engage the upwardly extending lip on the cup-shaped base. The outsetting of this lip provides a shoulder that abuts the shoulder circumjacent the upstanding lip on the cup-shaped base. The shoulder at the lower end of the cover has a downwardly projecting tab of a size so as to fit into the notch formed by interrupting the upstanding lip on the cup-shaped base.

By reason of the above construction, the rib and groove automatically provide a predetermined angular relationship of the pedestal with respect to the base, and the downwardly extending tab on the cover assures a predetermined angular relationship between the cover and the base. In this way, owing to the aligned interfitting of the pedestal with respect to the base, and the aligned interfitting of the cover with respect to the base, the cover is properly oriented, as far as its slant top is concerned, with the pedestal. Hence, the slant top on the cover is always in proper registry or juxtaposition with the pedestal, avoiding a skewed relationship of the cover relative to the pedestal, which situation would detract from the display of the jewelry item.

BRIEF DESCRIPTION OF THE DRAWINGS

FIG. 5 is a horizontal sectional view taken in the direction of line 5—5 of FIG. 1;

FIG. 6 is a perspective view of the base and cover, the view being what can best be described as an "open face" view with the cover's slant top residing in a plane perpendicular to that of the drawing sheet;

FIG. 7 is a rear elevational view of the pedestal shown in 1–6;

FIG. 8 is a bottom plan view of the pedestal of FIG. 7;

DESCRIPTION OF THE PREFERRED EMBODIMENT

Figure 1:
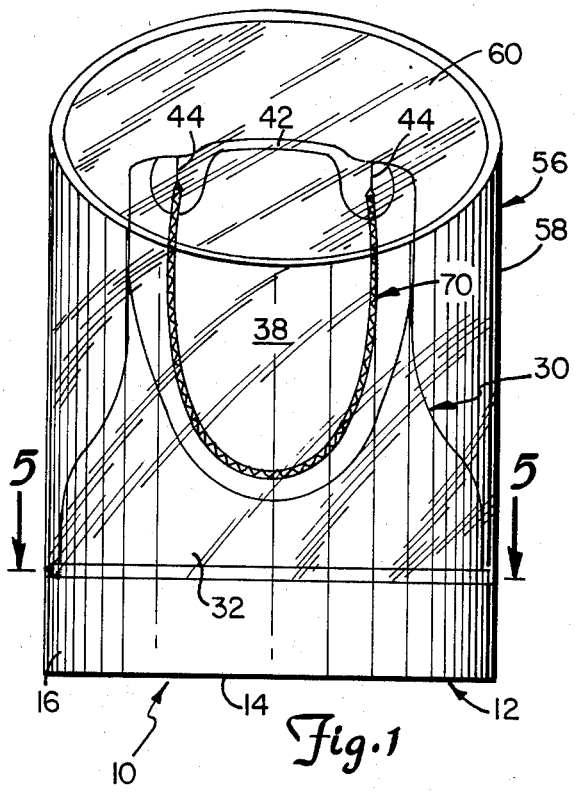
FIG. 1 is a front elevational view of a jewelry container exemplifying the invention, the view displaying a flexible necklace.
Figure 2:
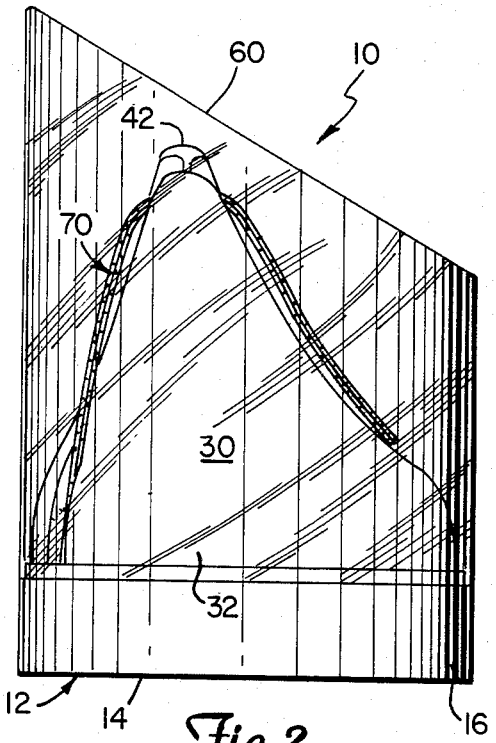
FIG. 2 is a side elevational view taken from the left in FIG. 1.

The jewelry container illustrating the invention has been denoted generally by the reference numeral 10. It is comprised of three parts. The first part to be described is a cup-shaped base 12, suggestively of styrene plastic material. The base 12 has a circular or disk bottom 14 and an upstanding cylindrical wall 16. Playing an important role in the practicing of the invention is a longitudinal rib 18 that extends vertically upwardly from the circular bottom 14, the rib 18 terminating at a location beneath the upper edge of the cylindrical wall 16 for a reason hereinafter made clear.

It is to be noted that the upper edge of the wall 16 is formed with a radially inset circular lip 20, the lip having a thickness equal to approximately ½ the thickness of the cylindrical wall 16, thereby forming a circumjacent shoulder 22 at the base of the inset lip 20. The lip 20 is interrupted to form a notch 24 that is in vertical alignment with the previously mentioned longitudinal rib 18. Since the upper end of the rib 18 terminates at an elevation beneath the upper edge of the cylindrical wall 16, it follows that the rib 18 also has its upper end at a location spaced beneath the notch 24, as readily understood from FIG. 6.

A second part belonging to the container 10 is one form of a pedestal indicated generally by the reference numeral 30, the pedestal being a resilient styrene shell. The pedestal 30 is molded with a lower cylindrical portion 32 of a diameter such as to be insertable into the cup-shaped base 12. It will be soon recognized that the lower cylindrical portion 32 is rendered appropriately resilient and grooved so that it can be manually flexed or squeezed sufficiently to produce a somewhat reduced diameter, thereby enabling this portion to be more readily slipped into the cup-shaped base 12, but immediately expanding when the lower portion is released by the person inserting the pedestal 30 into the base 12 so that it frictionally bears against the inside of the wall 16.

The pedestal 30 has a tapered intermediate portion 34 that merges or blends into an upper portion 36, the upper portion 36 being composed of generally flat panels 38 and 40 that converge toward each other to form a relatively narrow top end 42. The top end 42 has a pair of laterally spaced vertical slits 44 formed therein.

The cylindrical lower portion 32 is formed with a longitudinal groove 46 that extends vertically. The purpose of the groove 46 is to embrace or receive therein the previously mentioned longitudinal rib 18 when the cylindrical lower portion 32 of the pedestal is fully inserted into the cup-shaped base 12. Inasmuch as the rib 18 terminates in a spaced relation beneath the notch 24, as earlier herein alluded to, the lower portion 32 can be inserted partway down, the pedestal 30 then twisted to establish registry between the lower partial end of the groove 46 and the rib 18, so that the partial insertion can be completed.

A pair of additional grooves 48, these grooves being wider and somewhat longer than the groove 46, perform a dual function in this embodiment. One of the two purposes is to render the cylindrical portion 32 more resilient by allowing the user to compress the portion 32, the resulting smaller diameter enabling the portion 32 to be more readily inserted into the cup-shaped base 12. If rendered sufficiently resilient, the cylindrical portion 32 can be reduced in diameter to the extent that this portion of the pedestal 30 can be completely inserted when oriented at any angle with respect to the base 12, then being twisted until the groove 46 becomes aligned with the rib 18; in this situation the cylindrical portion 32 literally snaps back to its original diameter with the rib 18 extending into the groove 46 to maintain the preestablished angular relationship.

Inasmuch as the pedestal 30 is to be viewed, particularly in the merchandising or selling of jewelry, it is planned that the exterior of the pedestal 30 have an attractively flocked surface. To indicate such a surface, the pedestal 30 has been stippled in FIG. 7.

The third part comprising the container 10 is a cover 56 of clear styrene so that it is transparent, permitting the pedestal 30 to be seen therethrough. The cover 56 includes a cylindrical body 58 having a slant top 60; stated somewhat differently, the slant top 60 resides in an inclined truncated plane.

The lower end of the cover 56, that is, at the lower end of the cylindrical body 58, has a circular lip 62 that depends downwardly, the lip 62 being radially outset (in contradistinction to the insetting of the lip 20 on the cylindrical wall 16 of the base 12). In this way, a downwardly facing shoulder 64 is formed, the shoulder 64 being innerjacent the lip 62. There is a downwardly extending tab 66 having a shape complementing that of the notch 24. Although imperceptible in FIG. 6, the notch 24 diverges slightly in an upward direction, whereas the tab 66 converges to the same degree in a downward direction. Hence, the tab 66 fits easily into the notch when the cover 56 is properly placed on the cup-shaped base 12.

Inasmuch as the chief purpose of the invention is to appealingly display various items of jewelry, it will be of benefit to show a particular piece of jewelry for which the pedestal 30 is intended to hold, a flexible necklace 70 being pictured. It will be appreciated, particularly from FIGS. 1 and 3 that segments of the necklace can be pressed into the slits 44, the inherent resiliency of the shell-like pedestal 30 enabling this to be easily done. By so doing, one portion of the necklace 70 is draped over the upper portion 36 of the pedestal, more specifically confronting the front and rear panels 38 and 40. Additional sections of the necklace extend downwardly via the pair of grooves 48 (which also enable the diameter of the lower portion to be pressurally reduced) so that the clasp portion of the necklace 70 resides on the bottom 14 of the base 12, as best understood from FIG. 4.

Figure 3:
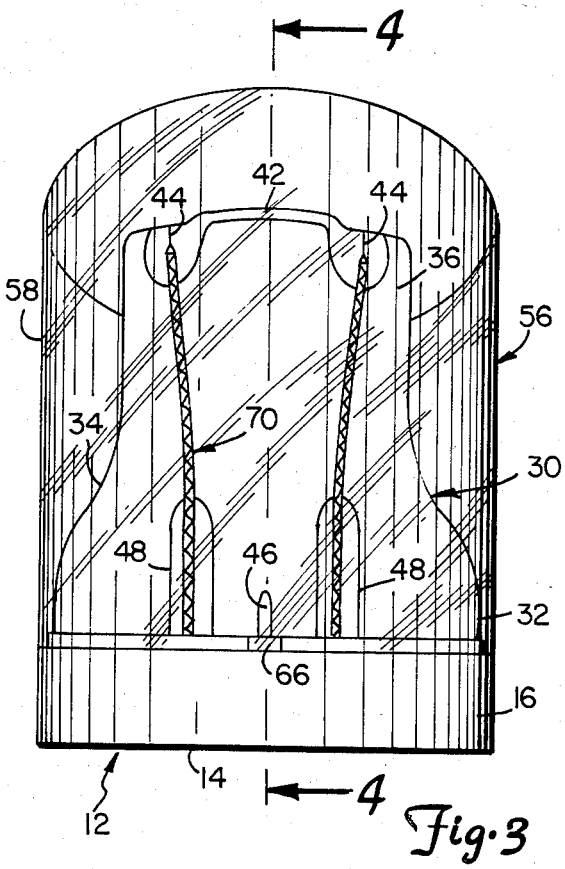
FIG. 3 is a rear elevational view.
Figure 4:
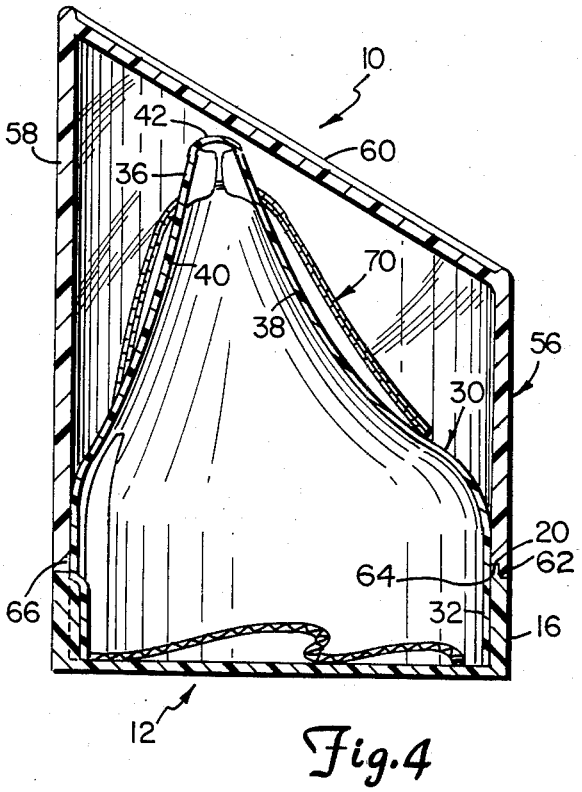
FIG. 4 is a vertical sectional view through the center of the container, the view being taken in the direction of line 4—4 of FIG. 3.
Figure 9:
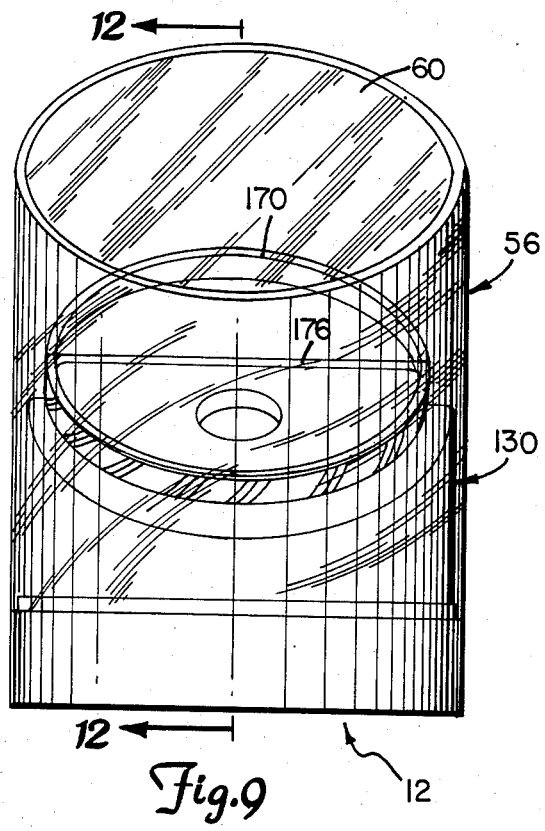
FIG. 9 is a front elevational view similar to FIG. 1, but displaying a bangle.
Figure 10:
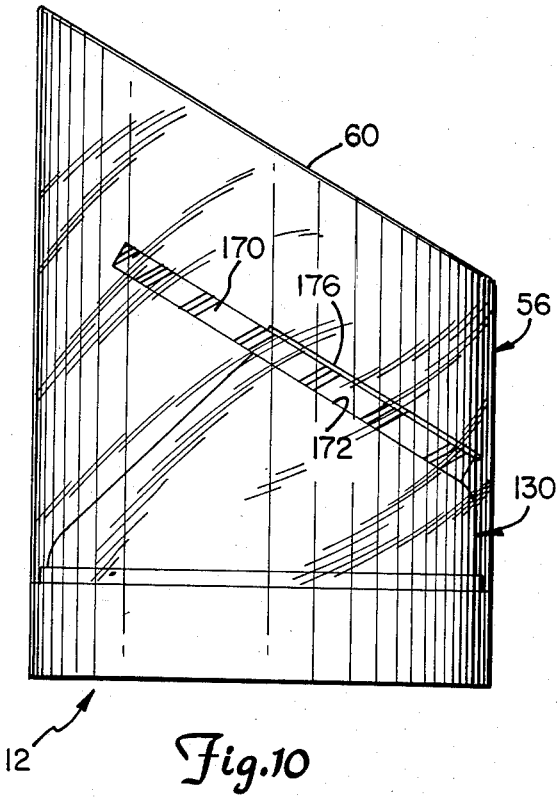
FIG. 10 is a side view taken from the left in FIG. 9.
Figure 11:
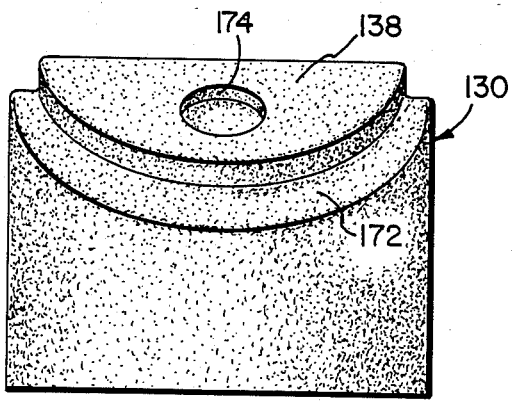
FIG. 11 is a front elevational view of the modified pedestal and retention panel shown in FIGS. 9 and 10.
Figure 12:
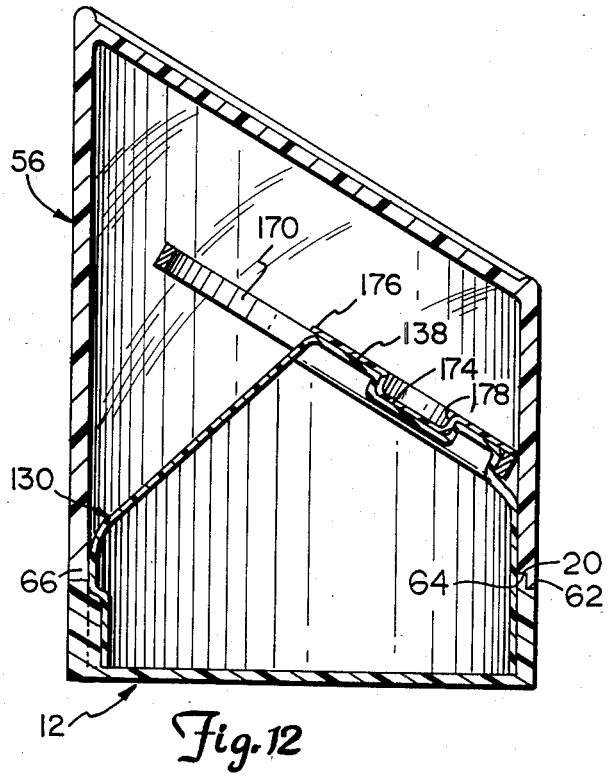
FIG. 12 is a vertical section taken in the direction of line 12—12 of FIG. 9.

The grooves 48 thus perform a dual purpose in that they accommodate sections of the necklace, as readily discernible from FIG. 3, and also enable the circular bottom portion 32 of the pedestal 30 to be compressed into a slightly smaller diameter to facilitate the insertion of the cylindrical portion 32 downwardly into the cup-shaped base 12, more specifically within the upstanding cylindrical wall 16 that is an integral portion of the base 12. It will be appreciated, especially since the base 12 is relatively thick, that the base 12 is quite rigid. It is the pedestal 30, being in the form of a thin resilient shell of flocked styrene, that the pedestal 30, more specifically its lower cylindrical portion 32, can be pressed easily down into position within the confines of the upstanding cylindrical wall 16. It is important to realize that the groove 46, when the rib 18 is received therein, establishes a preferred angular relationship between the pedestal 30 and the base 12.

After inserting the pedestal 30 into the base 12, the user then places the cover 56 onto the base 12. It is, of course, important that the slant top 60 of the cover 56 be oriented properly with the pedestal 30. It is the function of the tab 66 to do this. The tab 66, when vertically aligned with the notch 24, then enables the two lips 20 and 62 to be telescopically fitted together to the extent that the lip 20 abuts the shoulder 64, and the lip 62 abuts the shoulder 22. In other words, the two lips 20 and 62, being of proper diameters, provide a slip joint or rabbet fit when the tab 66 moves downwardly into the notch 24. It will be appreciated that the cup-shaped base 12, which is of relatively thick styrene, and the generally cylindrical cover 56, which is also of relatively thick styrene, are quite rigid when compared to the pedestal 30, which is of much thinner styrene.

When the parts 12, 30 and 56 of jewelry container 10 are assembled in the manner described above, it follows that the pedestal or part 30 initially assumes the proper angular relationship with the cup-shaped base or part 12 due to the interfitting of the rib 18 in the groove 46. The angular relation between the cover or part 56 and the base 12, as determined by the tab 66 and the notch 24, assures the proper juxtapositioning of the cover 56, and hence its slant top 60, with respect to the base 12. This, in turn, establishes the desired relationship between the cover 56 and the pedestal 30 so that the necklace 70 is correctly located in the container 10. When practicing the teachings of the present invention, this interrelationship of all three parts 12, 30 and 56 is readily realized with a minimum of time and effort on the part of the user.

FIGS. 9–12 are intended to show the versatility of our invention. The base 12 and cover 56 are identical, so the same reference numerals are used. However, the pedestal 130 differs from the pedestal 30 in that a bangle 170 is to be appropriately held for viewing. As illustrated, the pedestal 130 constitutes a simplified structure. While grooves corresponding to the grooves 48 in the pedestal 30 could be utilized in the instant embodiment to enhance the resiliency of the pedestal 130, they are omitted, especially since they are not needed to accommodate portions of a flexible necklace, such as the flexible necklace 70. The bangle 170, of course, constitutes a rigid bracelet. To properly support the bangle 170, a semicircular shoulder 172 is peripherally formed in the lower portion of the sloping front panel 138, which panel 138 is also generally semicircular.

Spaced upwardly from the semicircular shoulder 172 in the sloping panel 138 is a circular indentation or cavity 174. A readily detachable semicircular panel 176 of clear styrene confronts the panel 138, the panel 176 having a circular boss 178 projecting from one face thereof. The diameter of the boss or projection 178 is correlated with that of the circular cavity to provide a snug fit, thereby releasably holding the panel 176 in its overlying relation with the panel 138. The panel 176 is of particular advantage in retaining the bangle 170 in place on the panel 138 prior to fitting the cover 56 to the base 12. The panel 176 continues to function as a retainer for the bangle 170 after the cover 56 is engaged with the base 12, although the cover itself can assist in doing this, the degree of assistance depending, however, on the relative dimensions of the shoulder 172 and whatever bangle 170 is being displayed.

It should also be appreciated that the slope of the panel 138, and its shoulder 172, should possess a slope generally corresponding to that of the cover's slant top 60. The bangle 170, in this way, is better viewed and more attractively displayed.

The pilfer-resistant character of the container 10 is preserved whether the pedestal 70 is used or whether the pedestal 170 is used. As previously mentioned, appropriate tape can be utilized. All that need be done is to apply such tape (not illustrated) around the region where the cover 10 separates from the base 12, more specifically where the lip 62 engages the shoulder 22. The tape thwarts the removal of the jewelry article 70 or 170. The tape, if desired, may have tamper-proof character, a property that can, if desired, for all intents and purposes prevent opening of the container 10 in a store. Generally, though, a pressure sensitive tape is desired which can be peeled off and reapplied in the presence of a salesperson, thereby permitting the prospective buyer to try on the jewelry if she so chooses.

Due to (1) the simple construction of our jewelry container 10, (2) the ease of assembling the parts in a predetermined relationship, (3) the ability to view the aesthetically oriented jewelry contained therein, and (4) the protection against pilferage afforded by taping the base 12 and cover 56 together, our invention has considerable commercial appeal, especially for use in self-service stores.

We claim:

1. A jewelry container comprising a cup-shaped base including a circular bottom and a cylindrical wall extending upwardly from the periphery of said circular bottom, said cylindrical wall having a longitudinally directed rib disposed on the interior thereof at one angular location, a pedestal for holding and displaying a jewelry article to be contained, the pedestal having a substantially cylindrical lower portion of a diameter to fit within said cylindrical wall and having an upper portion extending above said cylindrical wall, said pedestal also having a longitudinally directed groove receiving said rib therein to establish a predetermined angular relationship of said pedestal with respect to said cylindrical wall, the upper portion of said pedestal including a generally flat sloping panel, a cylindrical-shaped cover, said cover having a slant top, and means releasably interfitting the lower edge of said cover to the upper edge of said cylindrical wall when said pedestal is in said predetermined angular relationship with respect to said base, the slant top of said cover being in a predetermined angular relationship with said pedestal when said pedestal is in its said predetermined relationship with said base.

2. A jewelry container in accordance with claim 1 including interengaging means on the upper edge of said cylindrical wall and the lower edge of said cover for establishing the predetermined angular relationship of said cover with respect to said base so that said predetermined angular relationship is thereby established between said cover and said pedestal.

3. A jewelry container in accordance with claim 2 in which said interfitting means includes telescoping lips on the upper edge of said cylindrical wall and on the lower edge of said cover.

4. A jewelry container in accordance with claim 3 in which the lip on the upper edge of said cylindrical wall is radially inset, and the lip on the lower edge of said cover is radially outset, said interengaging means including a longitudinally directed tab inset from said outset lip and said inset lip being interrupted to form a notch in general alignment with said rib, said longitudinally directed tab being of a size to fit in said notch to establish said predetermined angular relationship of said cover with respect to said base.

5. A jewelry container in accordance with claim 4 in which the upper end of said rib is spaced beneath said notch, and said groove extends to the bottom of the circular portion of said pedestal.

6. A jewelry container in accordance with claim 1 in which said pedestal constitutes a relatively thin flexible and resilient plastic shell engageable with said circular bottom innerjacent said cylindrical wall.

7. A jewelry container in accordance with claim 6 in which the lower portion of said pedestal has a pair of additional grooves to either side of said longitudinally directed groove to increase the flexibility of said shell.

8. A jewelry container in accordance with claim 7 in which the width or said additional grooves is greater than the width of said longitudinally directed groove.

9. A jewelry container in accordance with claim 1 in which the upper portion of said pedestal includes an intermediate portion tapering from said lower cylindrical portion to said upper portion.

10. A jewelry container in accordance with claim 9 in which the top of said upper portion has a pair of laterally spaced slits formed therein.

11. A jewelry container in accordance with claim 1 in which the upper portion of said pedestal includes a second generally flat sloping panel, one of said panels being generally semicircular and having a generally semicircular shoulder at its periphery.

12. A jewelry container in accordance with claim 11 in which said one panel has an indentation spaced from said semicircular shoulder.

13. A jewelry container in accordance with claim 12 in which said indentation constitutes a circular cavity.

14. A jewelry container in accordance with claim 13 including a separate panel for confronting said one panel, said separate panel having a circular projection engageable in said circular cavity and having a diameter such as to snugly fit within said circular cavity to retain said separate panel in a confronting relationship with said one panel.

15. A jewelry container in accordance with claim 1 in which said cover is transparent.

16. A jewelry container in accordance with claim 1 in which said base, cover and pedestal are styrene, said cover being transparent, the cylindrical wall of said base and said cover having substantially the same thickness, and said pedestal being substantially thinner than said cylindrical wall and said cover.

* * * * *